United States Patent [19]

Clemente

[11] 4,366,783

[45] Jan. 4, 1983

[54] HYDRAULICALLY OPERATED FAN ASSEMBLY FOR A HEAT EXCHANGER ASSEMBLY

[76] Inventor: Roger Clemente, 1789 Vauxhill Rd., Union, N.J. 07083

[21] Appl. No.: 320,886

[22] Filed: Nov. 13, 1981

[51] Int. Cl.[3] ..... F01P 7/10

[52] U.S. Cl. ..... 123/41.12; 123/41.49

[58] Field of Search ..... 123/41.12, 41.46, 41.49, 123/41.65, 41.66; 236/35

[56] References Cited

U.S. PATENT DOCUMENTS 3,120,219 2/1964 Nallinger ..... 123/41.12
3,853,098 12/1974 Ishikawa et al. ..... 123/41.12 X
3,942,486 3/1976 Kirchner ..... 123/41.12
4,062,329 12/1977 Rio ..... 123/41.49 X

*Primary Examiner*—William A. Cuchlinski, Jr.
*Attorney, Agent, or Firm*—Louis E. Marn; Elliot M. Olstein

[57] ABSTRACT

There is disclosed a fan assembly for a heat exchanger such as a radiator for an internal combustion engine, and comprised of a fan driven by a hydraulic motor in fluid flow communication with a hydraulic pump including an electrically-operated magnetic clutch assembly disposed on the shaft of the hydraulic pump which is activated in response to the opening-closing of a thermostatic switch. This fan is preferably formed of two blades and of the axial flow, propeller type S-configuration.

12 Claims, 2 Drawing Figures

HYDRAULICALLY OPERATED FAN ASSEMBLY FOR A HEAT EXCHANGER ASSEMBLY

FIELD OF INVENTION

This invention relates to a fan assembly for cooling a fluid passing through a heat exchange, and more particularly to a fan assembly for a heat exchanger or radiator cooling a coolant circulating through an internal combustion engine.

BACKGROUND OF THE INVENTION

Internal combustion engines are maintained at operating temperatures by circulating an intermediate heat transfer fluid or coolant, such as ethylene glycol, water or the like through conduits or hoses disposed between the engine and a heat transfer assembly, commonly known as a radiator, wherein the heated coolant is passed through conduits in a core thereof and is cooled by ambient air passing through the radiator core in indirect heat tranfer relationship to the coolant flowing through the conduits. The coolant is permitted to flow through the radiator core and engine through such related conduits or hoses by the opening of a thermostat normally disposed in the internal combustion engine. Thus, coolant flow is permitted upon opening of the thermostat with the understanding the coolant flow may vary between no flow (closed) and full flow. Similarly, freon for air conditioning units are passed after compression through a heat exchanger to cool the compressed fluid prior to expansion into the heat exchanger through which air is passed in cooling heat transfer relationship.

Generally, to effect a flow of air through the radiator core sufficient to effecting cooling of the coolant, a fan assembly including at least a four blade fan configuration is provided on the engine side of the radiator to draw air therethrough, rotation of the fan blade being directly related to the RPM's of the internal combustion engine. Thus, the slower the RPM's of the engine, the slower is the rotation of the fan resulting in a smaller quantity of forced air flow.

In copending application Ser. No. 159,589 filed July 16, 1980, there is disclosed a fan assembly for a radiator comprised of a fan driven by an electric motor and formed of two blades of the axial flow, propeller type S-configuration wherein the radiator is disposed in a conventional manner forward of the automobile engine.

Compaction of the automobile has required relocation of the heat exchange or radiator from such conventional position to alternate positions consistant with reasonable fluid flow conditions for the intermediate heat transfer fluid. Thus, the radiator may be mounted aside the motor, i.e. perpendicular to the conventional position, or in some other location on the vehicle. While the fan assembly of the aforesaid copending application is adequate where natural convection condition's effect a heat transfer relationship or a result of the velocity of the vehicle, alternate mounting of the heat exchanger or radiator necessitate a more positive flow of cooling air through the heat exchanger or radiator.

Hydraulic fan assemblies have found some usage and have been associated with an electrically or air operated flow divider. Flow dividers are very expensive and are constantly working under high pressures. When operation of the fan is required, the flow divider is closed thereby starting the fan motor. In such a system, the hydraulic pump is constantly being turned by the engine thereby wasting energy and causing unnecessary wear and tear on the hydraulic pump. Additionally, such type of system requires a by-pass line to a reservoir to recycle hydraulic fluid since the hydraulic pump is in constant operation. Consequently, since the hydraulic pump is in constant operation, a heat exchanger is required to cool the hydraulic fluid.

OBJECTS OF THE INVENTION

It is an object of the present invention to provide a novel fan assembly for a radiator of an internal combustion engine of a vehicle.

Still another object of the present invention is to provide a novel fan assembly for a radiator of an internal combustion engine of a vehicle providing for more positive flow of cooling air through the radiator.

A further object of the present invention is to provide a novel fan assembly for a radiator of an internal combustion engine of a vehicle where the radiator is mounted in a non-conventional position.

Yet another object of the present invention is to provide a novel fan assembly for a radiator of an internal combustion engine of a vehicle utilizing *hydraulic fluid* to activate a hydraulic motor to cause rotation of a fan of the fan assembly.

A still further object of the present invention is to provide a novel hydraulic fan assembly for a radiator of an internal combustion engine of a vehicle eliminating heat exchange requirements for hydraulic fluid.

Another object of the present invention is to provide a novel hydraulic fan assembly for a radiator of an internal combustion engine of a vehicle permitting of improved fuel efficiency, reduce engine noise and efficacious monitoring of engine compartment temperature.

SUMMARY OF THE INVENTION

These and other objects of the present invention are achieved by a fan assembly for a heat exchanger or radiator of a vehicle and comprised of a fan driven by a hydraulic pump and a hydraulic motor rotated by an endless belt driven by a pully disposed on a rotational member of the vehicle wherein the hydraulic pump and hydraulic motor are in fluid communication with one another.

BRIEF DESCRIPTION OF THE DRAWINGS

These and other objects of the present invention will become clear by reference to the following detailed description when taken with the accompanying drawings where like numerals designates like parts throughout and wherein.

DETAILED DESCRIPTION OF THE DRAWING

Figure 1:
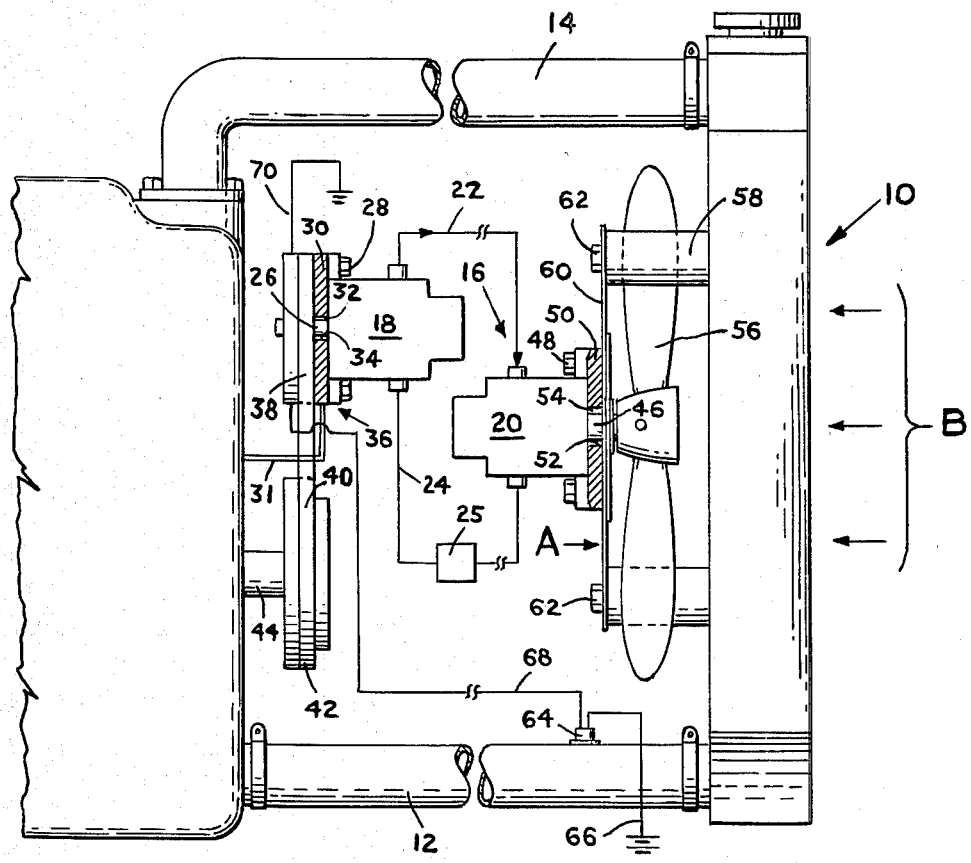
FIG. 1 is a plan side view of a radiator and fan assembly of the present invention.
Figure 2:
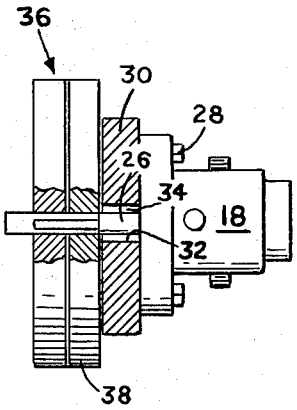
FIG. 2 is an enlarged, partial cross-sectional view of the hydraulic motor.

Referring now to the drawings, there is illustrated a radiator assembly, generally indicated as 10, for an internal combustion engine of a vehicle having a coolant inlet conduit 12 and coolant outlet conduit 14. In the interest of clarity, the radiator assembly 10 is illustrated as being generally conventional mounted, with the broken lines indicating that positioning of the radiator may be other then in such conventional mounting configuration.

Disposed between the radiator assembly 10 and the internal combustion engine, there is provided a fan assembly, generally indicated as 16, comprised of a hydraulic pump 18 and a hydraulic motor 20 in hydraulic fluid flow communication via conduits 22 and 24 and reservoir 25. The hydraulic pump 18 including a shaft 26 is mounted, such as by stud assemblies 28, to a support plate 30 mounted by a bracket 31 to the internal combustion engine. The plate 30 is formed with an orifice 32 and is provided with a bearing 34 in which the shaft 26 of the hydraulic motor 18 is mounted for rotation. On the shaft 26, there is mounted a magnetically operated clutch assembly, generally indicated as 36, including a pulley wheel 38 as known to one skilled in the art. An endless belt 40 is coursed about the pulley wheel 38 and about a pulled wheel 42 mounted on a crank shaft 44 of the engine of the vehicle.

The hydraulic motor 20 including a shaft 46 is mounted, such as by stud assemblies 48, to a support plate 50 formed with an orifice 52 and provided with a bearing 54 in which shaft 46 is mounted for rotation. A fan 56 is mounted on the shaft 46 of the hydraulic motor 20 and is illustrated as being of the two blades axial flow, propeller type S-configuration; although other fan blade configurations are contemplated. The support plate 50 including hydraulic motor 20 and fan 56 is disposed proximate the radiator assembly 10 of the automobile by spacer elements 58 for positioning support bars 60 to which the support plate 50 is mounted, such as by bolt and stud assemblies 62.

The fan assembly 16 includes a thermostatic switch 64 connected to a positive power source by line 66, preferably positioned in the lower conduit 12 for more accurate termperature sensing.

The thermostatic switch 64 is preferably selected to respond to a closed mode to a coolant temperature of from 180° to 190° F., and to respond to a opened mode at a coolant temperature of from 165° to 175° F. whether or not an engine thermostat (not shown) is provided in the internal combustion engine. Generally, thermostats used have an operational temperature of about 192° F. to minimize pollutant introduction into the atmosphere. The thermostatic switch 64 is connected by line 60 to the electrically operated magnetic clutch assembly 36. The electrically-operated magnetic clutch assembly 36 is grounded by attaching it to the frame of vehicle.

In operation, upon keying the ignition switch (not shown) of the vehicle provided with the fan assembly 16 of the present invention, the hydraulic motor 18 is in a disabled state and remains in such state until the temperature of the coolant reaches a predetermined temperature, e.g. 185° F. sensed by the thermostatic switch 64 at which point the thermostatic switch 64 closes completing a circuit via the battery 66 thereby energizing the electrically-operated magnetic clutch 36 thereby causing the shaft 26 of the hydraulic pump 18 to rotate and cause hydraulic fluid to be discharged under pressure through line 22. Such flow of fluid in line 22 causes the shaft 46 of the hydraulic motor 20 to rotate in a clockwise direction when viewed in the direction of arrow A and thus caused the fan 56 attached thereto to rotate in a clockwise direction thereby causing air to be drawn through the radiator 10 as indicated by the arrows B.

The thermostatic switch 64 remains closed until a predetermined lower temperature is reached, e.g. 165° F. caused for example by exceeding about 20 to 30 miles per hour for extended time periods, if the radiator is disposed in a convention position whereby forced convection through the radiator is sufficient to maintain the coolant temperature at the desired operating level, at which point the thermostatic switch 46 opens thereby disengaging the electrically operated magnetic clutch 36 to place the system in an OFF mode. It will be understood by one skilled in the art that alternate positioning of the radiator will effect switiching of the thermostatic switch 64.

As hereinabove mentioned, the radiator assembly 10 of the vehicle may be disposed at any convenient position on the vehicle, and generally conventionally in front of the engine. Generally, the fan 56 of the fan assembly 16 is mounted between the radiator assembly 10 and internal combustion engine whereby clockwise rotation of the fan 56 of the fan assembly 16 draws air through the radiator 10 although the fan 56 and hydraulic motor 20 of the present invention may be mounted in front of the radiator to push air through the radiator. It is readily appreciated that under sustained driving conditions wherein the radiator is conventionally mounted and the vehicle exceeds a speed of about 20 to 30 miles per hour the switch 64 and the hydraulic motor 22 will be disabled and the fan 56 is permitted to rotate by the passage of forced air. Energy savings are realized dependent on the enegry required to rotate a belt driven fan which when converted to an increase in fuel economy amounts to up to 15 percent or more, since the hydraulic fan assembly 16 of the present invention is operated only on an when-needed basis.

The fan assembly of the present invention may be included as original equipment on the vehicle or may replace an existing unit. Additionally, the fan assembly of the present invention may be used as original or replacement equipment in conjunction with heat exchangers requiring food convection to cool a fluid, such as oil, or an intermediate heat transfer fluid, such as freon, for air conditioners, refrigerators, and the like. Thus, the fan assembly of the present invention is mounted proximate to the heat exchanger preferably in a position to draw air through the heat exchanger with the thermostatic switch being responsive to preselect temperature levels with the hydraulic pump being driven by belt drive with the crankshaft.

While the invention has been described in connection with several exemplary embodiments thereof, it will be understood that many modifications will be apparent to those of ordinary skill in the art; and that this application is intended to cover any adaptations or variations thereof. Therefore, it is manifestly intended that this invention by only limited by the claims and the equivalents thereof.

What is claimed is:

1. A fan assembly for a heat exchange assembly associated with a vehicle having an internal combustion engine, wherein a heat transfer fluid is passed through said heat exchanger assembly, which comprises:

a support means positioned proximate said heat exchanger assembly;

a hydraulic motor including a drive shaft mounted to said support means;

a fan mounted on said drive shaft of said hydraulic motor;

a hydraulic pump including a shaft mounted proximate said internal combustion engine including a pulley assembly;

an electrically-operated magnetic clutch assembly disposed on said shaft of said hydraulic pump, and including a pulley;

fluid conduit means including a reservoir disposed between said hydraulic pump and said hydraulic motor;

belt means disposed between said pulley assembly of said internal combustion engine and said pulley of said hydraulic pump; and a thermostatic switch mounted within said radiator assembly, said thermostatic switch responsive to preselect upper temperature level whereby said thermostatic switch assumes a closed mode to activate said electrically-operated magnetic clutch assembly thereby to cause said shaft of said hydraulic pump to rotate and effect fluid flow of hydraulic fluid from said hydraulic pump to said hydraulic motor thereby to rotate said fan.

2. The fan assembly as defined in claim 1 wherein said heat exchanger assembly is a radiator assembly for cooling a heat transfer fluid being passed, through said internal combustion engine.

3. The fan assembly as defined in claim 2 wherein said fan assembly is mounted between said radiator and said internal combustion engine and said fan is caused to rotate to draw air through said radiator.

4. The fan assembly as defined in claim 2 wherein said themostatic switch is disposed in said outlet conduit of said radiator assembly.

5. The fan assembly as defined in claim 2 wherein said preselect upper temperature level is of from 160° to 200° F.

6. The fan assembly as defined in claim 2 wherein said thermostatic switch is placed in a closed mode at a temperature of from 180° to 190° F. and an opened mode at a temperature of from 165° to 175° F.

7. The fan assembly as defined in claims 1 or 2 wherein said support means include a plate member formed with an orifice having a bearing mounted therein for receiving a drive shaft of said hydraulic motor.

8. The fan assembly as defined in claims 1 or 2 wherein said shaft of said hydraulic pump is positioned having disposed in an orifice of a plate member.

9. The fan assembly as defined in claim 8 wherein said plate member is mounted to said internal combustion engine.

10. The fan assembly as defined in claim 2 wherein said radiator assembly is non-aligned with said internal combustion engine.

11. The fan assembly as defined in claim 1 wherein said heat exchange assembly cools a refrigerant.

12. The fan assembly as defined in claim 1 wherein said reservoir is disposed in said fluid conduit means on a suction side of said hydraulic pump.

* * * * *